US012751546B2

(12) United States Patent
Thieschafer

(10) Patent No.: US 12,751,546 B2
(45) Date of Patent: Oct. 6, 2026

(54) PALLET RACKING INCLUDING FALL PREVENTION APPARATUS AND METHODS

(71) Applicant: Garlock Safety Systems, Inc., Plymouth, MN (US)

(72) Inventor: Jacob Thieschafer, Coon Rapids, MN (US)

(73) Assignee: Garlock Safety Systems, Inc., Plymouth, MN (US)

( * ) Notice: Subject to any disclaimer, the term of this patent is extended or adjusted under 35 U.S.C. 154(b) by 546 days.

(21) Appl. No.: 18/351,560

(22) Filed: Jul. 13, 2023

(65) Prior Publication Data

US 2024/0016292 A1 Jan. 18, 2024

Related U.S. Application Data

(60) Provisional application No. 63/389,031, filed on Jul. 14, 2022.

(51) Int. Cl.

| | |
|---|---|
| ***A47B 96/14*** | (2006.01) |
| ***A47B 81/00*** | (2006.01) |
| ***E04G 5/14*** | (2006.01) |

(52) U.S. Cl.

CPC ..... *A47B 96/14* (2013.01); *A47B 81/00* (2013.01); *E04G 5/14* (2013.01)

(58) Field of Classification Search

CPC ..... E04G 5/141; E04G 21/3228; E04G 5/14; A47B 96/14; A47B 81/00; Y10S 256/02; E01F 13/105; A47F 5/10; A47F 5/0018; A47F 5/103

USPC ..... 182/113; 256/DIG. 2; 404/6; 211/191

See application file for complete search history.

(56) References Cited

U.S. PATENT DOCUMENTS

| | | | | | |
|---|---|---|---|---|---|
| 4,822,206 | A * | 4/1989 | Roussel | E01F 13/085 | 404/6 |
| 4,858,382 | A * | 8/1989 | Ellgass | E01F 13/085 | 49/35 |
| 4,981,225 | A * | 1/1991 | Cole | B65G 1/02 | 211/208 |
| 5,170,829 | A * | 12/1992 | Duncan | B65G 1/02 | 160/84.02 |
| 5,573,125 | A * | 11/1996 | Denny | B65G 1/02 | 211/183 |
| 5,820,110 | A * | 10/1998 | Beu | E04H 3/123 | 52/9 |
| 6,173,846 | B1 * | 1/2001 | Anderson | A47B 47/027 | 211/183 |

(Continued)

*Primary Examiner* — Zoe Tam Tran

(74) *Attorney, Agent, or Firm* — Best & Flanagan LLP

(57) ABSTRACT

A fall prevention apparatus includes an obstacle biased from a pass into position to an obstruction position. A pallet abuts with the obstacle in the obstruction position extending into a passage in a pallet racking system including a shelf having decking defining a free edge and moves the obstacle to the pass into position when the obstacle extends generally parallel to the passage. The pallet slides on the obstacle in the pass into position and past the obstacle and is supported on the decking. When the pallet is past the obstacle, the obstacle is biased from the pass into position to the obstruction position to block access out of the passage. In one embodiment, the obstacle is pivotably mounted to the shelf about an axis parallel to the free edge and includes an abutment surface against which the pallet abuts and slides and an opposite limit plane for blocking access.

12 Claims, 5 Drawing Sheets

(56) References Cited

U.S. PATENT DOCUMENTS

| | | | | |
|---|---|---|---|---|
| 7,419,062 | B2 * | 9/2008 | Mason | A47F 1/126 211/59.3 |
| 8,794,866 | B2 * | 8/2014 | Petryshyn | E01F 13/085 404/6 |
| 9,464,392 | B2 * | 10/2016 | Teich | E01F 13/085 |
| 11,583,107 | B2 * | 2/2023 | Nagel | A47F 1/121 |
| 2014/0138330 | A1 * | 5/2014 | Hardy | A47F 7/0007 211/59.3 |
| 2014/0305891 | A1 * | 10/2014 | Vogler | A47F 1/126 211/59.3 |
| 2018/0266127 | A1 * | 9/2018 | Smith | E04G 21/3228 |
| 2022/0017305 | A1 * | 1/2022 | Larsson | B65G 1/1375 |

* cited by examiner

PALLET RACKING INCLUDING FALL PREVENTION APPARATUS AND METHODS

BACKGROUND

Methods and apparatus for preventing workers falling from pallet racking are shown and described.

Goods are often placed on pallets, and such pallets are placed on racking for storage. Specifically, pallets are stacked on shelves placed at various heights in the pallet racking. Pallets are loaded onto the shelves by being moved past a free edge typically by use of forklifts. Often, it is required for workers to inspect or otherwise manipulate goods located on pallets in turn located on racking shelves at various heights. A major concern is that such workers will unintentionally step past the free edge of the shelf while inspecting or otherwise manipulating the goods on the pallets and fall from the shelf elevation.

Thus, a need exists for methods and apparatus preventing workers from falling from shelves of pallet racking.

SUMMARY

This need and other problems in the field of pallet racking is solved by providing fall prevention apparatus and methods which provide an obstruction after pallets are located on shelves of the pallet racking. A fall prevention apparatus includes an obstacle biased from a pass into position to an obstruction position. A pallet abuts with the obstacle in the obstruction position extending into a passage in a pallet racking system including a shelf having decking defining a free edge and moves the obstacle from the obstruction position to the pass into position when the obstacle extends generally parallel to the passage. The pallet slides on the obstacle in the pass into position and past the obstacle and is supported on the decking of the shelf. When the pallet is past the obstacle, the obstacle is biased from the pass into position back to the obstruction position to block access out of the passage.

In the illustrated embodiment, the obstacle is pivotably mounted to the shelf about an axis parallel to the free edge and includes an abutment surface against which the pallet abuts and slides and an opposite limit plane for blocking access.

In the illustrated embodiment, the obstacle is biased by an inverted U-shaped spring including a bridge abutting with the obstacle and interconnecting first and second limbs terminating in coils in turn terminating in feet.

Illustrative embodiments will become clearer in light of the following detailed description in connection with the drawings.

DESCRIPTION OF THE DRAWINGS

The illustrative embodiments may best be described by reference to the accompanying drawings where.

Figure 1:
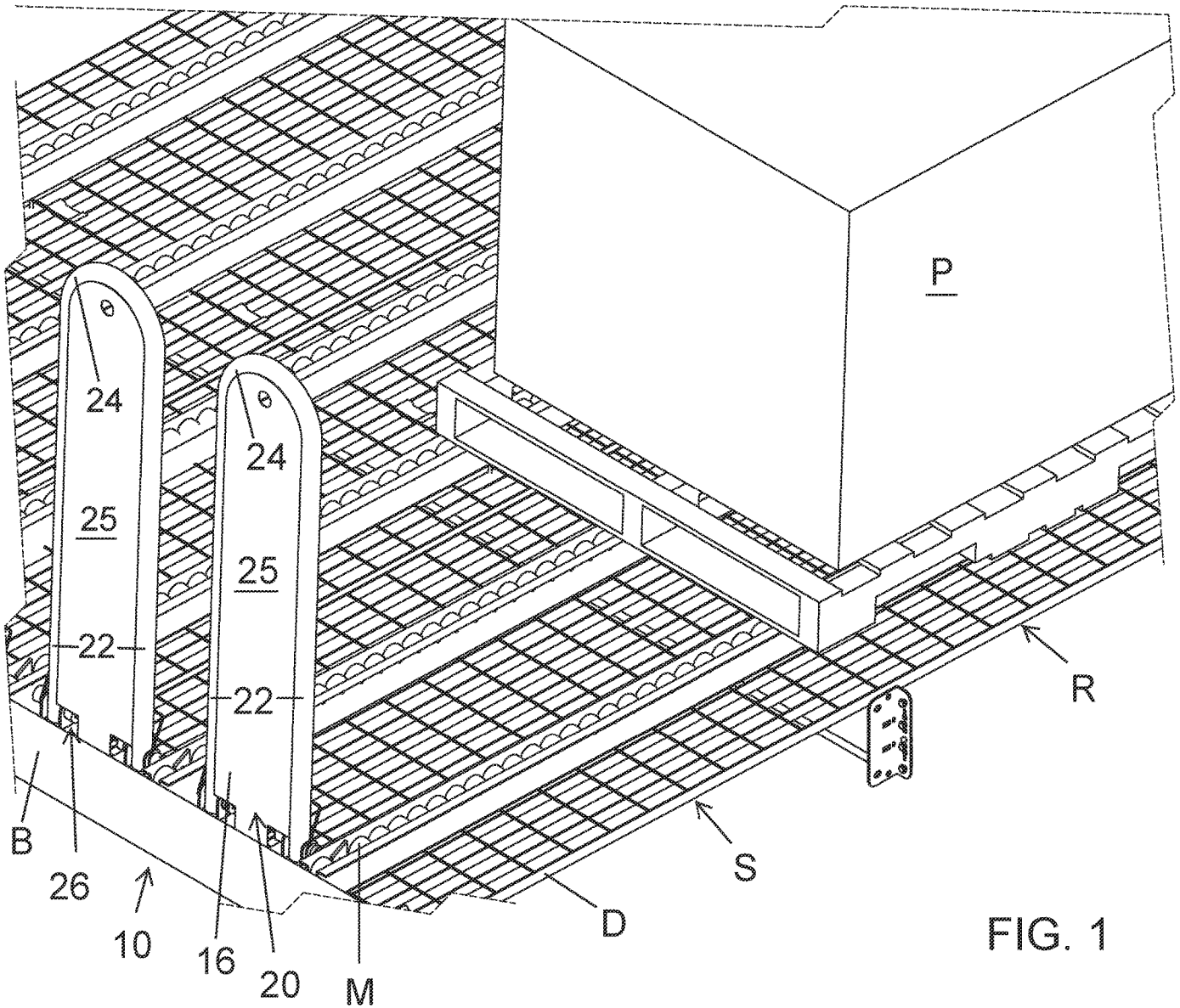
FIG. 1 shows a perspective view of a pallet racking including a fall prevention apparatus before and after a pallet is positioned thereon.

All FIGURES are drawn for ease of explanation of the basic teachings only; the extensions of the FIGURES with respect to number, position, relationship, and dimensions of the parts to form the illustrative embodiments will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various FIGURES of the drawings, the same numerals designate the same or similar parts. Furthermore, when the terms "top", "bottom", "first", "second", "forward", "rearward", "reverse", "front", "back", "height", "width", "length", "end", "side", "horizontal", "vertical", and similar terms are used herein, it should be understood that these terms have reference only to the structure shown in the drawings as it would appear to a person viewing the drawings and are utilized only to facilitate describing the illustrative embodiments.

DESCRIPTION OF THE ILLUSTRATIVE EMBODIMENTS

Fall prevention apparatus for pallet racking systems R is shown in the drawings and generally designated 10. Pallet racking systems R generally include a plurality of shelves S held at various elevations by posts which are not shown. Each shelf S includes a horizontal beam B which is suitably secured between a pair of posts. Each shelf S further includes suitable decking D upon which a pallet P could be supported and extending horizontally from beam B. Suitable provisions M can optionally be provided to moveably support pallet P on decking D and are shown as a parallel series of rollers extending horizontal generally perpendicular to beam B. In the drawings, horizontal beam B defines a free edge of shelf S past which pallet P is introduced through a passage in pallet rack system R and onto shelf S. It should be appreciated that pallet racking system R can take other forms or styles than illustrated, including, but not limited to, the horizontal beam B, decking D, and/or provisions M can take other forms and styles, with apparatus 10 also taking other forms and styles accordingly.

Apparatus 10 includes a limit plane 12 which is moveable between an obstruction position and a passage or pass through position, with the limit plane 12 preventing access out of the passage when in the obstruction position. In the obstruction position, limit plane 12 is generally perpendicular to decking D and parallel to beam B. In the passage position, limit plane 12 is positioned to allow pallet P to be introduced and pass through the passage of the pallet rack system R unto decking D past the free edge of shelf S. In the form illustrated, limit plane 12 is pivotal relative to pallet racking system R between the obstruction position extending into the passage of pallet rack system R and the passage position extending parallel to the passage of pallet rack system R. Particularly, limit plane 12 is pivotal about an axis 14 which is parallel to decking D, beam B and the free edge of shelf S. Specifically, in the form illustrated, axis 14 is contiguous with decking D.

Figure 4:
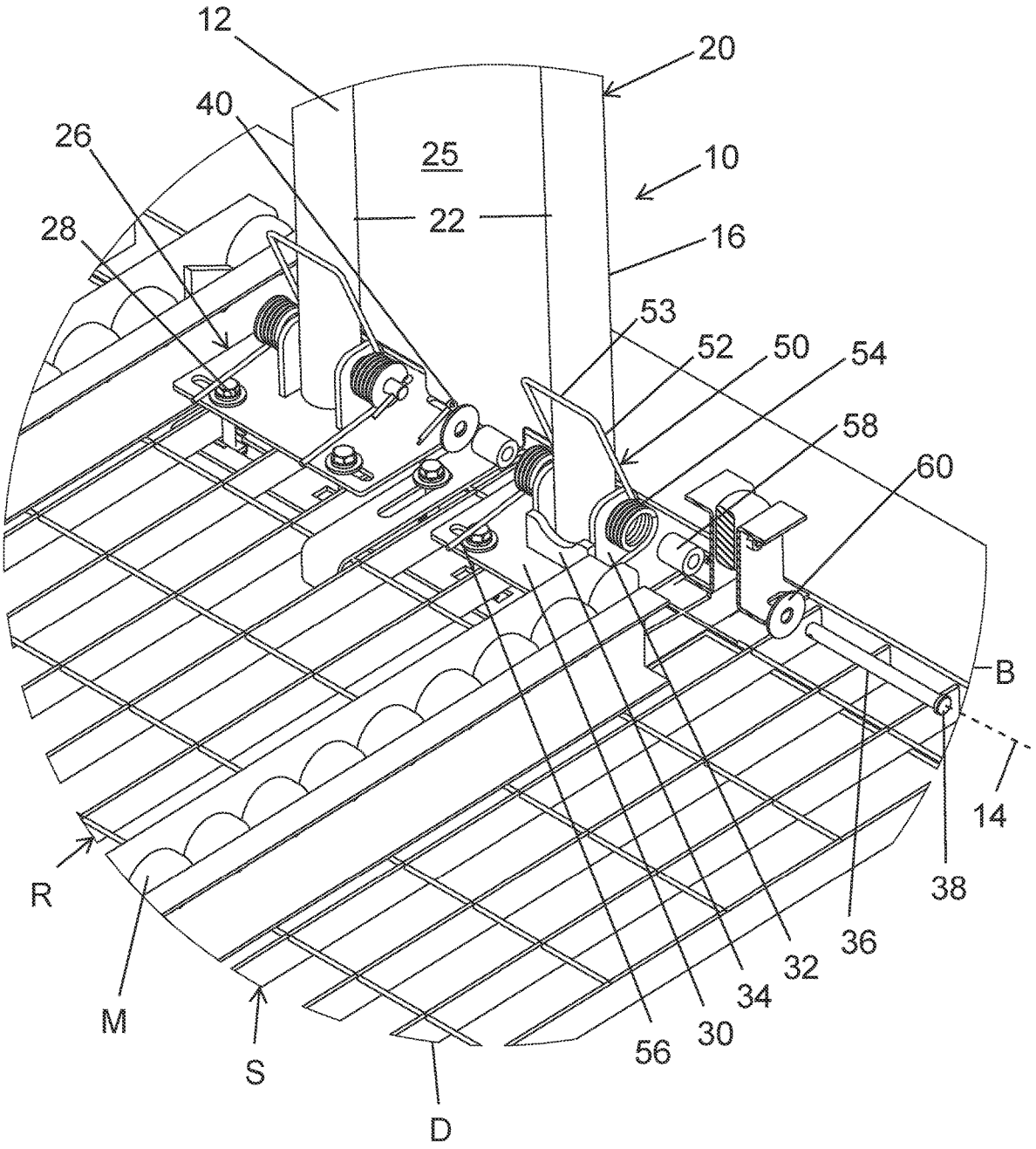
FIG. 4 shows an enlarged, exploded, partial perspective view of the pallet racking including the fall prevention apparatus of FIG. 1.
Figure 5:
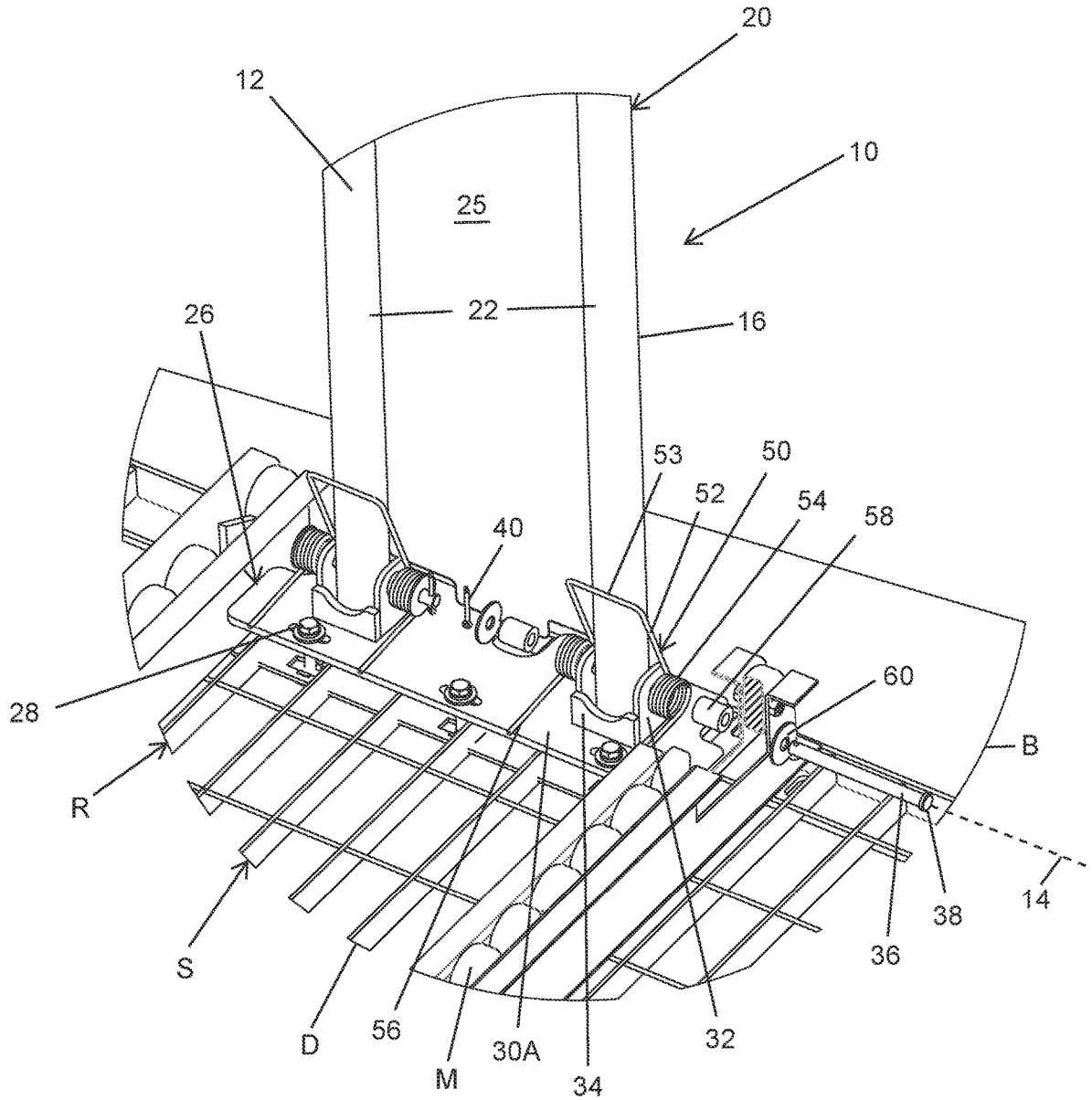
FIG. 5 shows an enlarged, exploded, partial perspective view of the pallet racking including a fall prevention apparatus modified from that of FIG. 1.

In the form illustrated, apparatus 10 generally includes one or more obstacles or restraints 20 of an inverted U shape. Particularly, each restraint 20 has first and second legs 22 interconnected by an arcuate portion 24 and at least one panel 25 fixed to and extending from arcuate portion 24 and between legs 22. Restraint 20 defines limit plane 12 and suitable provisions for abutting with and sliding on pallet P being introduced through the passage of pallet racking system R. In the form shown, an opposing abutment plane 16 of a planar shape is adapted to be pushed by pallet P and defines such abutting and sliding provisions. Apparatus 10 further includes first and second pivotal mounts 26 suitably secured to decking D such as by bolts 28. In the form shown in FIG. 4, each mount 26 includes a plate 30 extending parallel to decking D and secured thereto by bolts 28. A pair of ears 32 extend from each plate 30 with a spacing for slideably receiving a free end of leg 22. In the form shown in FIG. 5, first and second pivotal mounts 26 include an integral plate 30A extending parallel to decking D and secured thereto by bolts 28. Two pairs of ears extend from integral plate 30A with a spacing for slideably receiving a free end of leg 22. A brace 34 is suitably secured between each pair of ears 32 and to plate 30 or 30A, with brace 34 including an arcuate cutout opposite to plate 30 or 30A and between each pair of ears 32. Legs 22 are pivotally received and secured between the pairs of ears 32 such as by pins 36 extending through ears 32 and the free ends of legs 22. Pin 36 includes a head 38 at one end and a removable stop 40 at the opposite end such as a cotter key as illustrated. It should be appreciated that pins 36 form and define axis 14. Thus, it should be appreciated that restraint 20 is pivoted between the obstruction position and the pass through position, particularly is pivotally mounted to pallet racking system R, and specifically is pivotally mounted to shelf S of pallet racking system R.

Restraint 20 is biased to move from the passage position to the obstruction position. In the form illustrated, restraint 20 is biased by a spring 50 of an inverted U shape. Particularly, spring 50 includes an abutment of an inverted U shape having first and second limbs 52 extending generally perpendicular from a bridge 53. Each limb 52 terminates in a coil 54 in turn terminating in a foot 56 having a free end abutting with plate 30. Spring 50 is secured to ears 32 by pin 36 extending through collars 58 located inside of coils 54. Washers 60 are positioned between head 38 and collar 58 and coil 54 and between stop 40 and collar 58 and coil 54. In the obstruction position, the free ends of legs 22 abut with brace 34 to prevent restraint 20 from pivoting beyond the obstruction position away from the passage position, bridges 53 abut with legs 22 on the opposite sides of pins 36 than the free ends, and feet 56 abut with plate 30 or 30A. When moving to the passage position, bridges 53 move about an arc centered around pins 36 towards plate 30 or 30A while the free ends of legs 22 pivot in an arc centered around pins 36 away from braces 34.

Restraint 20 is positioned on decking D between a pair of provisions M with pins 36 generally parallel to and adjacent the free edge of shelf S. In the passage position, restraint 20 is positioned adjacent to decking D between the pair of provisions M with abutment plane 16 located at or below the pair of provisions M.

Now that the basic construction of apparatus 10 has been set forth, modes of operation and advantages thereof can be highlighted. After installation of apparatus 10, restraints 20 are biased into their obstruction positions as shown in FIG. 1 where pallet P is not present in front of shelf S and/or is present on shelf S spaced from the free edge of shelf S greater than the extent of restraints 20. In the obstruction position, limit plane 12 defined by restraints 20 is generally perpendicular to decking D and parallel to beam B and extending into the passage of pallet racking system R defining a movement limit for workers on shelf S. Thus, apparatus 10 prevents workers from moving past the free edge of shelf S and falling from shelf S of pallet racking system R.

Figure 2:
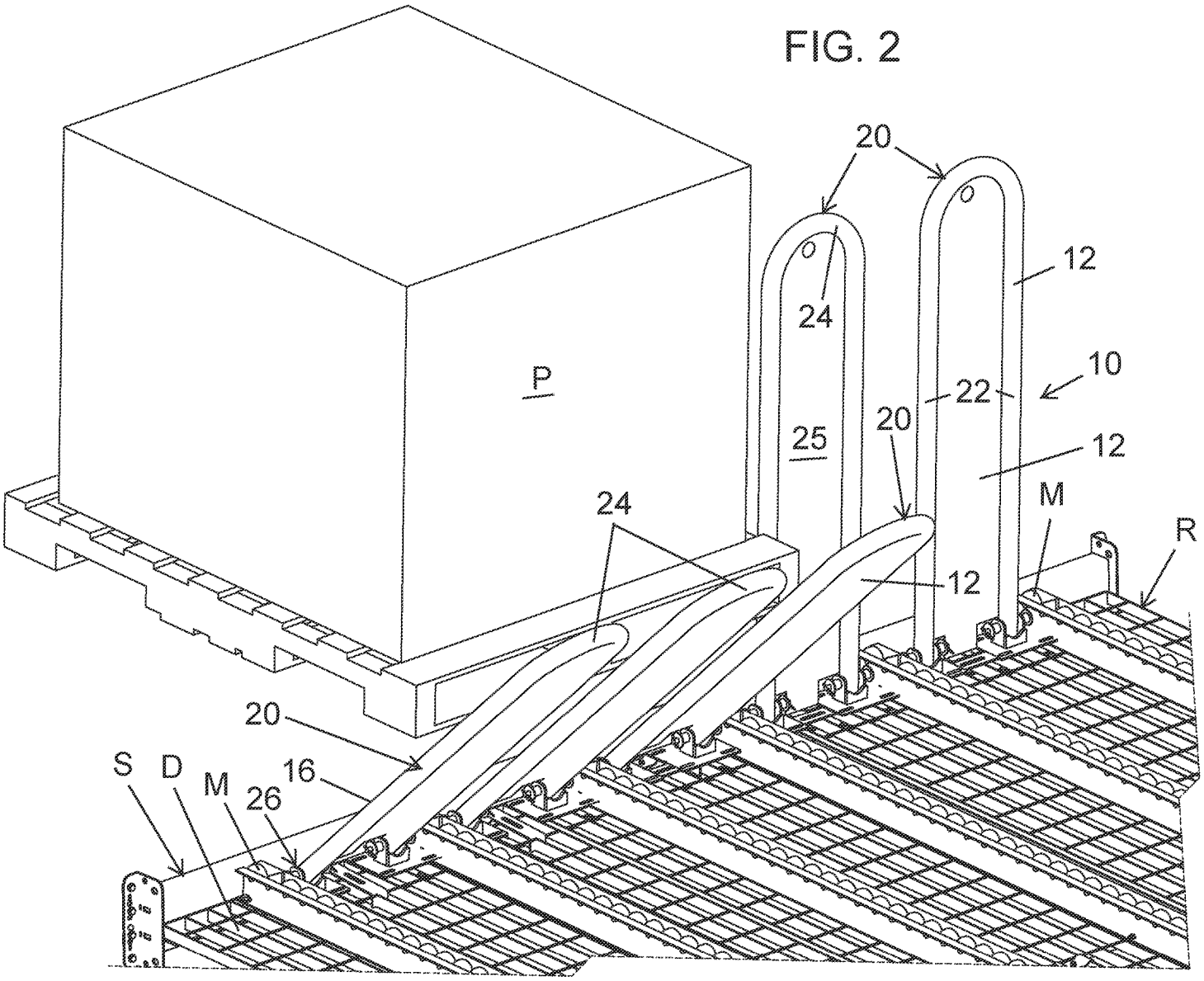
FIG. 2 shows a perspective view of the pallet racking including the fall prevention apparatus of FIG. 1 with a pallet being introduced into the pallet racking.
Figure 3:
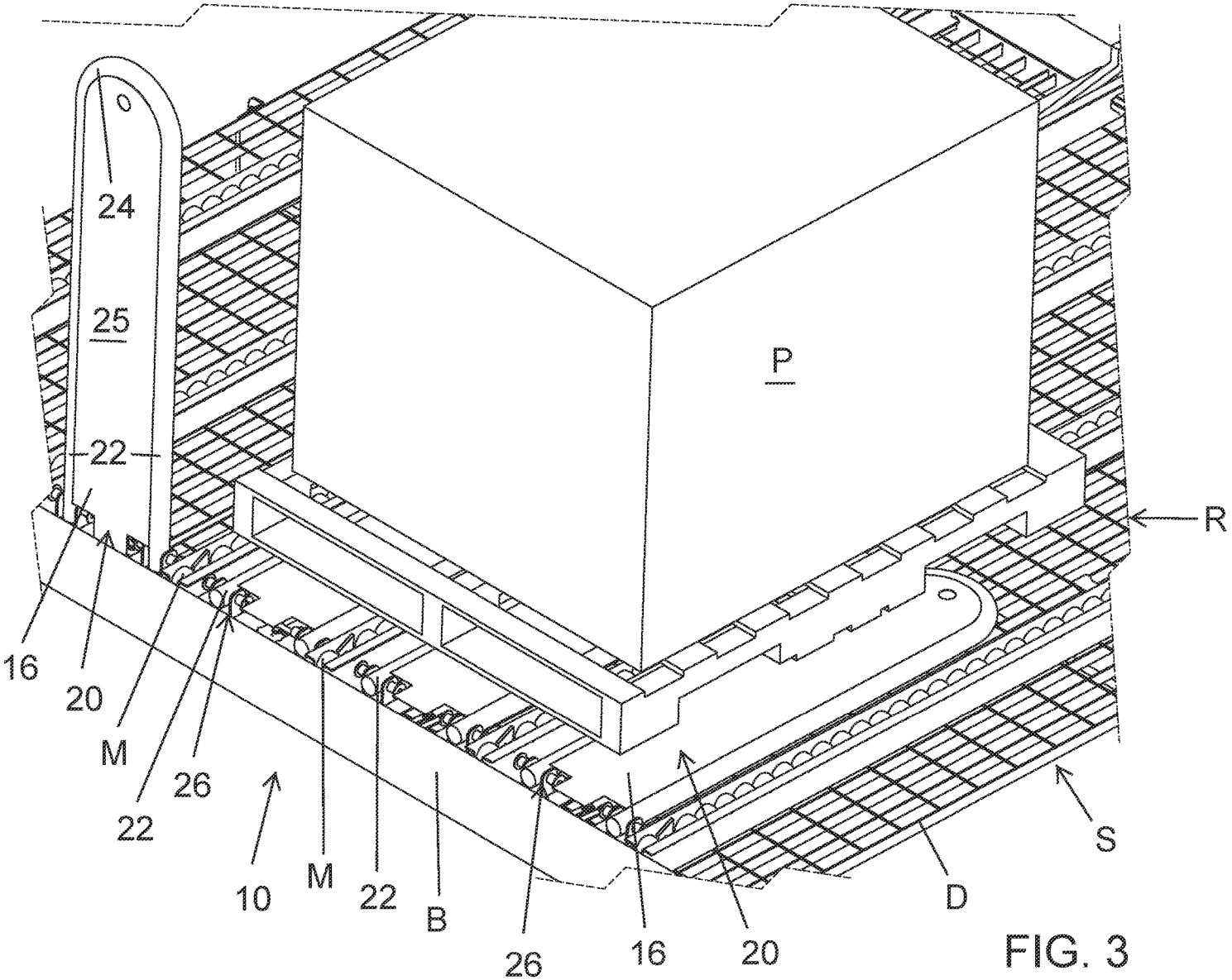
FIG. 3 shows a perspective view of the pallet racking including the fall prevention apparatus of FIG. 1 with a pallet being moved onto the shelf of the pallet racking.

When it is desired to place pallet P onto shelf S, pallet P is moved to abut with abutment plate 16 defined by restraints 20. As shown in FIG. 2, with continued movement of pallet P, pallet P pushes restraints 20 to pivot from their obstruction position towards their passage position. With continued movement of pallet P into shelf S, pallet P pushes restraints 20 to pivot from their obstruction position towards their passage position. With continued movement of pallet P into shelf S, pallet P can be lowered to rest upon provisions M and decking D with restraints 20 pivoting to their passage position extending generally parallel to the passage of pallet racking system R as shown in FIG. 3. It should be appreciated that pallet P can be positioned to generally extend past the free edge of shelf S but within the extent of restraints 20. In such a position, pallet P itself provides a movement limit for workers on shelf S.

It should be appreciated that when pallet P is moved beyond the free edge of shelf S and beyond the extent of restraints 20, restraints 20 move under the bias of springs 50 from the passage position to the obstruction position as shown in FIG. 1. In the obstruction position, limit plane 12 defined by restraints 20 is generally perpendicular to decking D and parallel to beam B and extending into the passage of the pallet racking system R defining a movement limit for workers on shelf S. Thus, apparatus 10 prevents workers from moving past the free edge of shelf S and falling from shelf S of pallet racking system R.

Although the form of restraints 20 is believed to produce synergistic results in at least in ease of fabrication, restraints 20 can take other forms and types which present limit plane 12 in the obstruction position. Similarly, although the form of springs 50 is believed to produce synergistic results in at least in ease of assembly and cost reduction, the method of biasing can take other forms and types which bias restraints 20 from the passage position towards the obstruction position. Additionally, although the manner of moveably mounting the restraints 20 to pallet racking system R is believed to produce synergistic results in at least in ease of automatic passage of pallets P without requiring other control operations, restraints 20 can be pivotably mounted in different manners and locations and/or can be movably mounted in a manner which allow movement between an obstruction position and a passage position.

Thus, since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A fall prevention apparatus configured to be mounted to a pallet racking system, the fall prevention apparatus comprising:

a shelf, with the shelf including decking upon which a pallet can be supported, with the decking defining a free edge past which the pallet can be introduced through a passage in the pallet racking and unto the decking, an obstacle biased from a pass through position extending parallel to the passage to an obstruction position extending into the passage, wherein:

the obstacle includes means for abutting with and sliding on the pallet being introduced through the passage, the obstacle is adapted to be pushed from the obstruction position to the pass through position while the pallet is being introduced into the passage, and the obstacle is biased to the obstruction position from the pass through position after the pallet was introduced into the passage and the obstacle is prevented from moving beyond the obstruction position from the pass through position, and in combination: a pivot mount including a first pair of ears between which the obstacle is pivotally received, and a brace extending between the first pair of ears, with a free end of the obstacle abutting with the brace in the obstruction position and with the free end of the obstacle spaced from the brace in the pass through position.

2. The fall prevention apparatus of claim 1, wherein the abutting and sliding means comprises an abutment surface of a planer shape upon which the pallet is slideable.

3. The fall prevention apparatus of claim 2, wherein the obstacle includes a limit plane opposite to the abutting and sliding means, with the limit plane preventing access out of the passage when the obstacle is in the obstruction position.

4. The fall prevention apparatus of claim 3, wherein the abutment surface is parallel to, but spaced from, the limit plane.

5. The fall prevention apparatus of claim 4, wherein the obstacle is pivotally mounted to the pallet racking.

6. The fall prevention apparatus of claim 5, wherein the obstacle is pivotally mounted to the shelf.

7. The fall prevention apparatus of claim 6 further comprising, in combination: a spring of an inverted U shape having first and second limbs interconnected by a bridge, with the bridge abutting with the obstacle, with each limb terminating in a coil in turn terminating in a foot; a collar located in each coil; and a pin extending through the collar in each coil, through the first pair of ears and through the obstacle.

8. The fall prevention apparatus of claim 7, wherein the obstacle comprises a restraint having a first leg of circular cross sections, with the brace including an arcuate cutout against which the first leg abuts in the pass through position.

9. The fall prevention apparatus of claim 8, wherein the restraint is of an inverted U shape and includes a second leg interconnected to the first leg by an arcuate portion, with the second leg pivotally received between a second pair of ears.

10. The fall prevention apparatus of claim 9 further comprising, in combination: first and second mounting plates, wherein the first and second mounting plates are removably connected to the shelf, with the first and second pair of ears extending from the first and second mounting plates respectively.

11. The fall prevention apparatus of claim 9 further comprising a mounting plate removably connected to the shelf, with the first and second pair of ears extending from the mounting plate.

12. The fall prevention apparatus of claim 1, wherein the obstacle is pivotally mounted to the shelf.

* * * * *